United States Patent [19]

Ruscitti

[11] Patent Number: 4,607,765

[45] Date of Patent: Aug. 26, 1986

[54] MANUALLY OPERATED PUMP FOR THE DELIVERY UNDER PRESSURE OF LIQUID SUBSTANCES

[75] Inventor: Tommaso Ruscitti, Milan, Italy

[73] Assignee: S.A.R. S.p.A., Chieti, Italy

[21] Appl. No.: 702,663

[22] Filed: Feb. 19, 1985

[30] Foreign Application Priority Data

Apr. 19, 1984 [IT] Italy ..... 21596/84[U]

[51] Int. Cl.[4] ..... B65D 88/54; B67D 5/40; F04B 7/04

[52] U.S. Cl. ..... 222/321; 222/383; 417/511

[58] Field of Search ..... 417/511, 413; 222/321, 222/383

[56] References Cited

U.S. PATENT DOCUMENTS

| | | | |
|---|---|---|---|
| 2,095,622 | 10/1937 | Wilson | 222/321 |
| 2,112,548 | 3/1938 | Wilson | 222/321 |
| 3,463,093 | 8/1969 | Pfeiffer et al. | 222/321 |
| 3,500,761 | 3/1970 | Clevenger et al. . | |
| 3,531,224 | 9/1970 | Clevenger et al. | 222/321 |
| 3,583,605 | 6/1971 | Corsette . | |
| 3,627,206 | 12/1971 | Boris | 222/321 X |
| 4,010,874 | 3/1977 | Steiman | 222/321 |
| 4,087,025 | 5/1978 | Steiman . | |
| 4,155,489 | 5/1979 | Steiman | 222/321 |
| 4,162,746 | 7/1979 | Anderson et al. . | |
| 4,193,551 | 3/1980 | Saito et al. . | |
| 4,434,916 | 3/1984 | Ruscitti et al. . | |

*Primary Examiner*—Carlton R. Croyle
*Assistant Examiner*—Theodore Olds
*Attorney, Agent, or Firm*—Oblon, Fisher, Spivak, McClelland & Maier

[57] ABSTRACT

A manually operated pump for the delivery under pressure in micronized form of liquid and/or thick substances or materials stored in a container on which the pump is mounted. The pump comprises a main hollow body, a movable hollow stem supporting a micronizing cap and extending into a pressure chamber defined by the hollow body, a spring urging the stem away from said chamber against a retaining element integral with the hollow body, a one-way valve sealingly bearing on a seat on the lower end of the chamber, an annular seal movable along the stem between two positions in which it clears and respectively it closes a channel in the stem opening into the axial cavity of the same stem, said seal sealingly engaging the inner surface of the hollow body and the outer surface of the stem. The pump is characterized in that the stem is provided with an annular collar positioned above the mentioned channel and which is defined by at least one frusto-conic surface and in that said seal has on elastic upper lip which is slidable upon said frusto-conic surface to urge the seal to close said channel.

4 Claims, 3 Drawing Figures

MANUALLY OPERATED PUMP FOR THE DELIVERY UNDER PRESSURE OF LIQUID SUBSTANCES

BACKGROUND OF THE INVENTION

1. Field of the Invention

The present invention relates to a manually operated small pump for the delivery under pressure of micronized liquid and/or thick substances. Known 2. Description of the Background Known are many types of pumps manually operated applicable on containers of liquid substances, for the delivery of liquid substances in micronized or nebulized form.

The simplest types of these pumps have the disadvantage that both nebulization of the liquid delivered and the pressure under which it is ejected out of the nozzle of the cap applied on each pump depend on the rate of actuation of the pump itself and on the pressure exercised thereon.

U.S. Pat. No. 4,228,931 and French Pat. No. 2,097,353, respectively, disclose two manual small pumps capable of delivering the liquid only when it reaches a minimum predetermined pressure inside of a pressure chamber which each pump is provided with.

This small pump comprises a seal moved by the action of a spring, said seal covers a hole for the passage of the liquid to the delivery can and it rises from this hole only after having imparted a predetermined pressure to the liquid contained in a pressure chamber making part of the same pump.

Under rest conditions, the above spring pushes the seal on a base integral with a movable stem making part of the pump: after the liquid present in the pressure chamber has reached the pressure sufficient to overcome the action of the spring on the seal, the seal rises from its sealing base making free the hole for the passage of the liquid towards the delivery cap.

Pumps of this type operate in a satisfactory manner, but they have a disadvantage consisting of the presence of the spring working on the seal as above-mentioned. In fact, the use of such springs increases the production cost of the pumps owing to both the cost of the springs and the cost of assembling them into the pumps (it should be noticed that the parts of these pumps have very small sizes, so that the right assembling of several different parts inside of the pumps is dificult): furthermore, being the spring made of metal or metal alloys, their presence can be incompatible with the use of corrosive liquids or the like.

SUMMARY OF THE INVENTION

It is primary object of the present invention to provide a manual pump having simple structure and low product cost and allowing the delivery of a liquid substance under pressure in completely nebulized form, avoiding the use of springs to maintain the seal pushed in its rest position. These and still further objects are achieved by a manually operated pump for the delivery under pressure in micronized form of liquid and/or thick substances or materials stored within a container on which the pump is mounted, comprising a main elongated hollow body having a small tube mounted at the lower end thereof for drawing the substance or material to be dispensed into a metering pressure chamber defined by said hollow body, an elongated hollow stem whose lower end is movable axially within the hollow body and whose upper end projects outside of the main body for supporting a nebulizing cap, a spring reacting between said body and said stem so as to urge the stem away from the bottom of the chamber, a retaining element preventing the stem from being unthreaded from the hollow body, a valve element housed in the lower zone of the metering chamber where it can sealingly bear on a shaped seat on the lower end of the chamber, an element for anchoring said pump on the mouth or inlet member of the container, a resilient annular seal received between the hollow body and said stem, said seal being movable axially of the hollow body between a position at which it clears at least one channel for providing communication between the metering pressure chamber and the stem cavity and a position in which it closes such channel, said seal having at least an outer lip slidably and sealingly engaged with the inner surface of the hollow body, an upper lip and at least an inner lip for sealing engagement on said stem, elastic means reacting between the stem and said seal so as to urge this last toward the bottom of the chamber against a stop rib projecting from the lower end of the stem and located below said channel, characterized in that the stem is provided with an annular collar positioned above said channel and whose surface is defined by at least one frusto-conic surface, and in that said upper lip of the seal has an annular elastically deformable edge which is slidable and urges upon said frusto-conic surface of the collar to form said elastic means reacting between the stem and the seal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
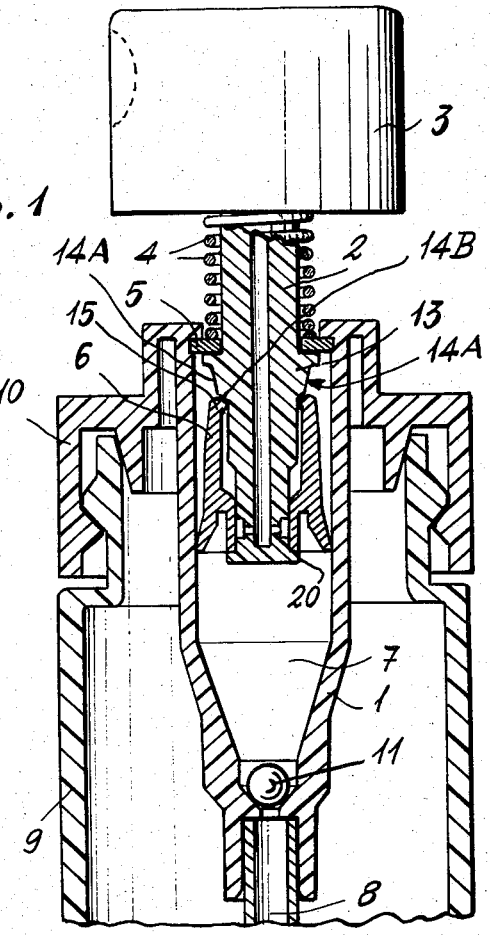
FIG. 1 is a longitudinal section of the pump mounted on a container, at rest condition.

Various other objects, features and attendant advantages of the present invention will be more fully appreciated as the same becomes better understood from the following detailed description when considered in connection with the accompanying drawings in which like reference characters designate like or corresponding parts throughout the several views and wherein the pump represented in the figures comprises a main hollow body 1, a stem 2 partially elongating into the hollow body 1 and projecting outside of the main body for supporting a nebulizing cap 3, a spring 4 reacting between said body 1 and said stem 2 to urge the stem away from said chamber, with a collar 13 pressed against a stop and sealing ring 5 integral with the main body 1, a shaped seal 6 made of resilient material, elastically deformable and movable in the chamber of the body 1 and sealing on the surface of this chamber and on the stem 2, and this shaped seal 6 together with the hollow body 1 delimitate a pressure chamber 7 for the liquid to be delivered. The lower end of the main body 1, that is the lower part of the enclosed figures, has applied thereto a small channel 8 drawing in the liquid to be pumped being in the container 9: the pump is mounted on this container with a ring 10 integral with the pump itself; in correspondence with the opening of the main body 1 there is a seat for a floating ball 11 working as a one-way valve, which allows the liquid to enter the pressure chamber 7 from the container while preventing the liquid from going out of this chamber when it is compressed.

Figure 2:
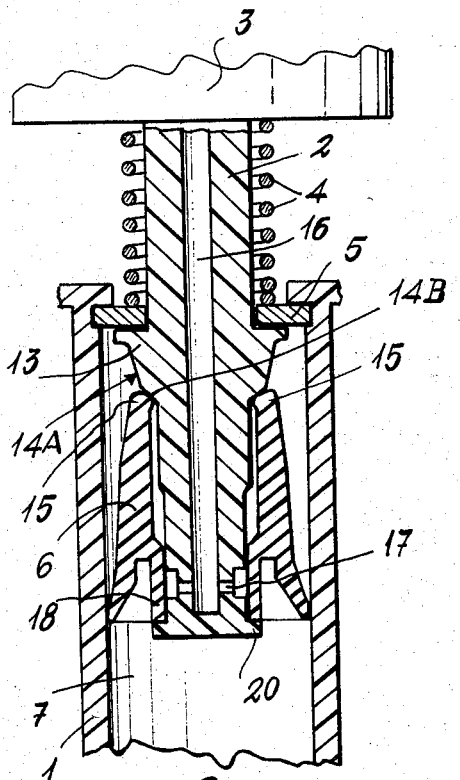
FIG. 2 is a partial and enlarged sectional view of the pump at the same conditions of FIG. 1.

As appears from the figures, the surface of the collar 13 of the stem towards the seal 6 is defined by two smooth frusto-conic surfaces 14A, 14B having different cone apex angles, while the upper lip of the seal 6 is shaped in the form of an elastic collar 15 which delimitates a hole having a diameter as equal as that of the stem 2 in part where the collar 15 is under rest conditions (FIGS. 1 and 2).

Figure 3:
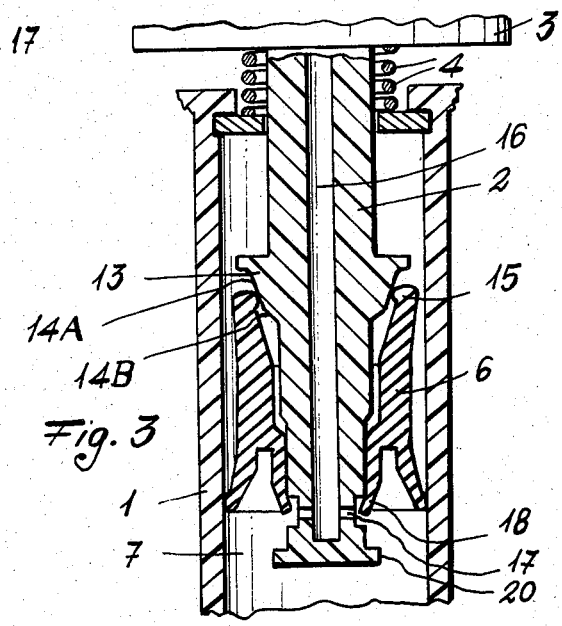
FIG. 3 is a partial and enlarged sectional view of the pump at the delivery conditions of the liquid under pressure.

Due to the above structure, when the collar 15 of the seal (during the actuation of the pump as following disclosed) comes into contact with the frusto-conic surface 14A, 14B (FIG. 3), said collar 15 will get elastically deformed so as to increase the diameter of the hole delimitated and, consequently, the collar 15 will slide down the frusto-conic surface 14A, 14B to go back to the rest position (FIGS. 1 and 2) wherein the lower lip of the seal urges the stop rib 20 of the lower end of the stem.

Moreover, the stem 2 is axially crossed by a channel 16 opening into the free end of the stem above the ring and into same radial channels 17 made in the stem above the stop rib 20 and in correspondence with the seal 6. Supposing the pump should be already operating at the rest conditions represented by FIGS. 1 and 2, that is the chamber 7 full of liquid. By pushing the cap 3, the stem 2 goes down dragging the seal 6 whose collar 15 urges the base of the frusto-conic surface 14B.

In the first phase of this movement of the stem, the frusto-conic surface 14B (having a very large apex angle) will drag down the seal 6, compressing the liquid in the chamber 7 until the elastic collar 15 get deformed towards the outside allowing the stem to go down while the frusto-conic surface 14B enter the room delimited by the collar 15. Further going down of the stem, the collar 15 comes into contact with the frusto-conic surface 14A of the stem without causing any change because, even if the section of the stem in correspondence with of the surface 14A is larger than that in correspondence with the surface 14B, it is actually true that the cone apex angle of the former is remarkably smaller than the latter.

The elastical deformation of the collar 15 (FIG. 3) is due to the fact that, during the lowering phase of the stem, the seal can not lower since the liquid contained in the pressure chamber 7 is incompressible and, therefore, it prevents this movement. By carrying on the lowering of the stem the collar 15 goes up until the top of the conical surface 14A: at a certain point the lower lip of the tubular surface 18 of the seal 6 makes free the channels 17 of the stem so that the liquid under pressure passes from the chamber 7 through the axial channel of the stem and it is ejected suddenly therefrom through the nozzle of the cap 3.

Analogously to the already known manual pumps, even if the lowering of the stem has manually stopped while keeping on the stem compressed downwards, the ejection continues under constant pressure until the elastic collar 15 of the seal 6 sliding on the frusto-conical surfaces 14A and 14B reaches the stop rib 20 of the stem where it stops (FIGS. 1 and 2).

We remark that the large cone apex angle defined by the surface 14B assures a high pressure of this surface on the collar 15 thus prefectly sealing up the seal 6 on the stop rib 20 of the stem.

An essential characteristic of the pump of the present invention consists in the elastic means capable of urging the seal 6, at the rest position, which so closes the channels 17 of the stem, said elastic means operate without any spring, but only in cooperation with the elastically deformable collar 15 of the seal 6 learning on and sliding on the frusto-conic surface 14A, 14B of the stem as above disclosed.

Another important characteristic of the pump, according to a preferred embodiment of the invention, is the spring 4 urging towards the top of the stem (with respect to the figures) which is positioned outside of the pressure chamber: in such a way, no metal part of the pump comes into contact with the liquid substance to be delivered which might be corrosive. In this case, the ball 11 is, obviously, made of glass or pottery or it can be replaced with a plastic nonreturn valve.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A manually operable pump for the delivery under pressure in micronized form of a liquid stored within a container on which the pump is mounted, comprising:

an elongated hollow body having a metering chamber formed therein, said metering chamber being bounded in part by an inner wall of said hollow body;

a tube for carrying said liquid to be dispensed into said metering chamber;

a one-way valve operably disposed between said tube and said metering chamber;

an elongated stem coaxially disposed in said hollow body and axially movable with respect thereto, an upper end of said stem projecting outside said hollow body and supporting a nebulizing cap, said stem having an axial passage therein, a channel extending between said axial passage and an outer surface of said stem communicating said metering chamber and said axial passage, and a stop rib disposed below said channel;

spring means reacting between said hollow body and said stem for biasing said stem away from the bottom of said metering chamber;

a resilient annular seal member slidingly disposed on said outer surface of said stem within said hollow body, said metering chamber being bounded in part by said seal member, said seal member and said stem being relatively axially displaceable between a first position wherein said seal member abuts said stop rib and blocks said channel and a second position wherein said seal member does not block said channel, said seal member comprising a radially outer lip resiliently sealingly engaging said inner wall of said hollow body in said first and second positions and an inner lip resiliently sealingly engaging said outer surface of said stem in said first and second positions, said outer surface of said stem comprising frusto-conic surface means coaxial with said stem for radially displacing said inner lip of said seal member when said seal member is moved from said first position toward said second position; and means for biasing said seal member toward said first position comprising said frusto-conic surface means and said inner lip of said seal member.

2. A manually operable pump as claimed in claim 1, wherein said spring means is disposed outside of said metering chamber, is wound around said stem, and reacts between a support ring integral with said hollow body and a shoulder of said stem.

3. A manually operable pump as claimed in claim 1, wherein said spring means is disposed outside of said metering chamber, is wound around said stem, and reacts between a support ring integral with said hollow body and said nebulizing cap.

4. A manually operable pump as claimed in claim 1, wherein said frusto-conic surface means comprises two axially contiguous frusto-conic surfaces having different apex angles, the frusto-conic surface that is nearer to said channel of said stem having the larger apex angle.

* * * * *